US008534593B2

(12) United States Patent
Casey et al.

(10) Patent No.: US 8,534,593 B2
(45) Date of Patent: Sep. 17, 2013

(54) METHOD AND APPARATUS FOR ALIGNING A PAPER ROLL

(75) Inventors: David W. Casey, Salisbury, NC (US); Gregg A. Bryan, Mooresville, NC (US); Karl U. Wuerminghausen, Canton, OH (US)

(73) Assignee: Greif Packaging LLC, Delaware, OH (US)

( * ) Notice: Subject to any disclaimer, the term of this patent is extended or adjusted under 35 U.S.C. 154(b) by 277 days.

(21) Appl. No.: 13/032,674

(22) Filed: Feb. 23, 2011

(65) Prior Publication Data

US 2012/0211586 A1 Aug. 23, 2012

(51) Int. Cl.
*B65H 16/06* (2006.01)

(52) U.S. Cl.
USPC ..... 242/596; 242/596.1; 242/534; 242/563

(58) Field of Classification Search
USPC ..... 242/596, 596.1–596.3, 559, 563, 242/534
See application file for complete search history.

(56) References Cited

U.S. PATENT DOCUMENTS

| | | | | |
|---|---|---|---|---|
| 4,893,763 | A | 1/1990 | Wales et al. | |
| 6,007,017 | A * | 12/1999 | Vorwerk | 242/563 |
| 6,328,249 | B1 * | 12/2001 | Ogawa et al. | 242/559.2 |
| 7,784,730 | B2 * | 8/2010 | Heimrich et al. | 242/599 |
| 7,832,682 | B2 * | 11/2010 | Keller et al. | 242/599.1 |
| 2006/0186259 | A1 * | 8/2006 | Birke et al. | 242/596.1 |
| 2009/0116948 | A1 * | 5/2009 | Keller et al. | 414/754 |

* cited by examiner

*Primary Examiner* — Sang Kim
(74) *Attorney, Agent, or Firm* — Sand & Sebolt

(57) ABSTRACT

A paperboard handling machine includes an alignment mechanism for aligning rolls of paperboard supported by the machine whereby the rolls are aligned with one another.

8 Claims, 7 Drawing Sheets

METHOD AND APPARATUS FOR ALIGNING A PAPER ROLL

BACKGROUND OF THE INVENTION

1. Technical Field

The present invention relates generally to machines used for handling paperboard, which is typically used in forming corrugated paperboard. More particularly, the present invention relates to an alignment mechanism for aligning rolls of paperboard with one another. Specifically, the invention relates to a method and apparatus for aligning one edge of a given roll of paperboard with a corresponding edge of another roll of paperboard.

2. Background Information

Machines for handling rolls of paperboard are well known in the art, including corrugating machines (corrugators), splicing machines (splicers) and the like. Each of these machines handles two or more rolls of paperboard such that the web of paperboard from one roll is ultimately combined with the web from one or more other rolls of paperboard. For instance, corrugators combine a corrugated medium with a flat web of paperboard to form corrugated paperboard. Splicers splice the trailing end of the web of one roll of paperboard with the leading end of the web of another roll of paperboard in order to create a continuous web formed from the two rolls. In these cases and in other instances, it is necessary to suitably align the rolls of paperboard with one another. Improper alignment ultimately results in a paperboard product which does not have clean or sharp edges and thus must typically be trimmed in order to provide such edges. This is a very common problem in the art inasmuch as the actual width of a given roll of paperboard is often slightly different than the width ordered by the customer, typically by ⅛ or ¼ inch or the like. Although known machines typically align the paperboard rolls with one another generally, they nonetheless align them in such a manner that the left and right edges of the rolls are slightly offset relative to one another such that both the left and right edges ultimately need to be trimmed. Thus, it would be desirable to have an alignment mechanism for aligning, for example, the left edges of the rolls in order to eliminate the need for subsequent trimming along the left edges. The present invention addresses this need in the art.

BRIEF SUMMARY OF THE INVENTION

The present invention provides a method comprising the steps of: providing a paperboard handling machine comprising a frame and a roll support assembly having left and right roll support arm assemblies which are movably mounted on the frame; mounting a first paperboard roll having left and right ends on the roll support assembly between the left and right arm assemblies; measuring with a first distance sensor a first axial distance from a first reference point to one of (a) the left end of the roll, and (b) a second reference point on the left arm assembly; calculating with a logic circuit a first axial position of the roll based on the first axial distance; comparing the calculated first axial position with a predetermined correct axial position; and if the first and correct axial positions are different from one another, adjusting the roll axially while mounted on the roll support assembly to move the roll from the first axial position to the correct axial position.

The present invention also provides a method comprising the steps of: providing a paperboard handling machine comprising a frame and a roll support assembly having left and right roll support arm assemblies which are movably mounted on the frame; mounting a first paperboard roll having left and right ends on the roll support assembly between the left and right arm assemblies; ascertaining a first value representing an ordered axial width of the roll;

measuring a first axial distance from a first reference point to a second reference point, wherein the first reference point is to the left of the left end of the roll and the second reference point is to the right of the left end of the roll; determining a second axial distance from the first reference point to the left end of the roll; calculating a calculated value including subtracting the second axial distance from the first axial distance; and moving the roll axially while mounted on the roll support assembly to a position at which the calculated value equals the first value.

The present invention further provides a paperboard handling machine configured for handling a paperboard roll having left and right ends, the machine comprising: a frame; left and right axially spaced roll support arm assemblies mounted on and axially adjustable relative to the frame; a roll-receiving space which is defined between the left and right arm assemblies and comprises a left side adjacent the left arm assembly and a right side adjacent the right arm assembly; the space adapted to receive therein the paperboard roll with the left and right ends respectively adjacent the left and right sides of the space; and a first distance sensor configured to measure a first axial distance from a first reference point to one of (a) the left side of the roll-receiving space, and (b) a reference point on the left arm assembly.

BRIEF DESCRIPTION OF THE SEVERAL VIEWS OF THE DRAWINGS

A preferred embodiment of the invention, illustrated of the best mode in which Applicant contemplates applying the principles, is set forth in the following description and is shown in the drawings and is particularly and distinctly pointed out and set forth in the appended claims.

Similar numbers refer to similar parts throughout the drawings.

DETAILED DESCRIPTION OF THE INVENTION

Figure 1:
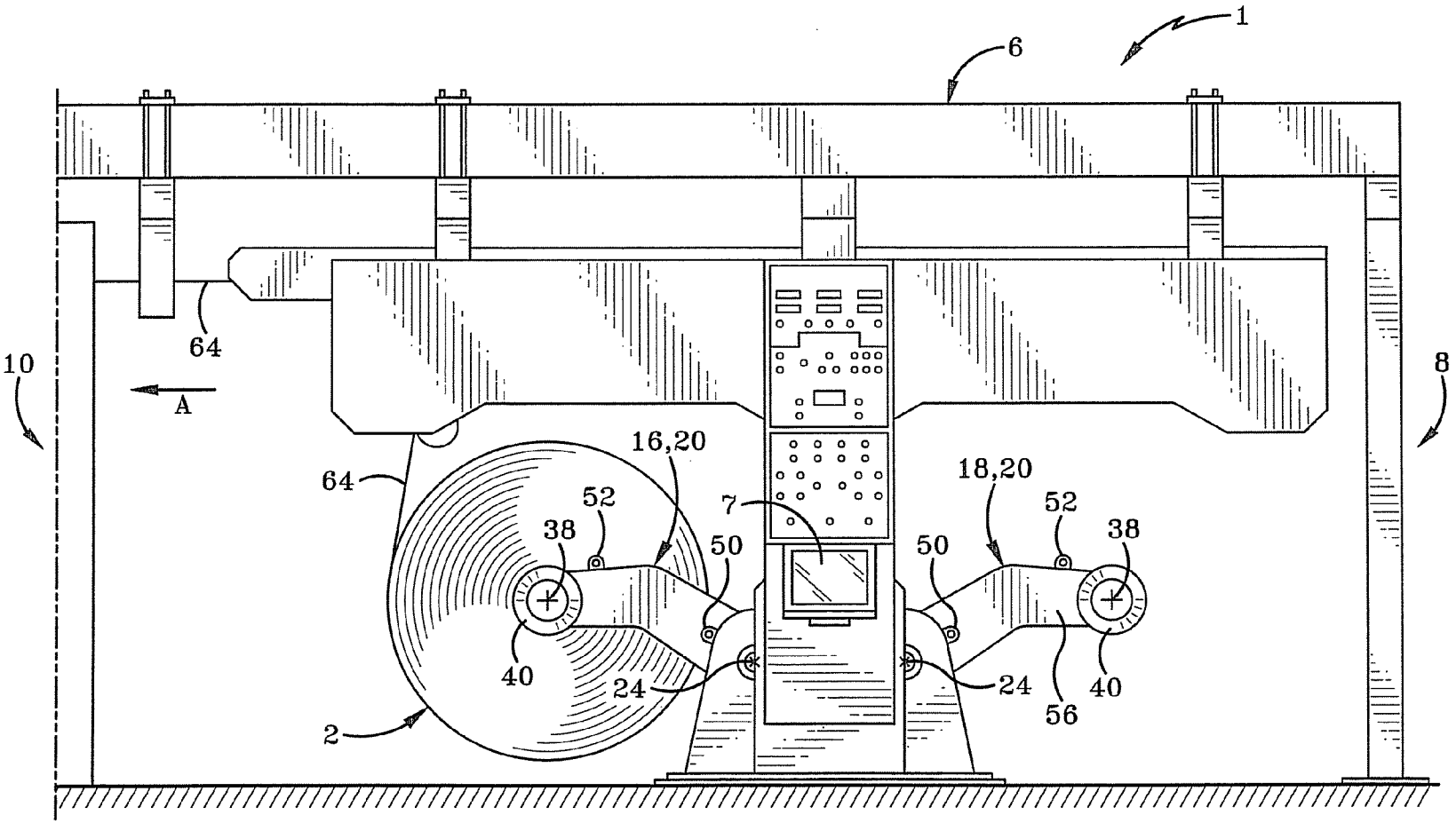
FIG. 1 is a side elevational view of the paperboard handling machine of the present invention showing one of the rolls of paperboard mounted thereon.

The paperboard handling machine of the present invention is shown generally at one in FIG. 1. Machine 1 is configured for handling and aligning first and second rolls 2 and 4 of paperboard. Machine 1 may also be configured to handle and align additional rolls of paperboard using the alignment mechanism described further below.

Figure 2:
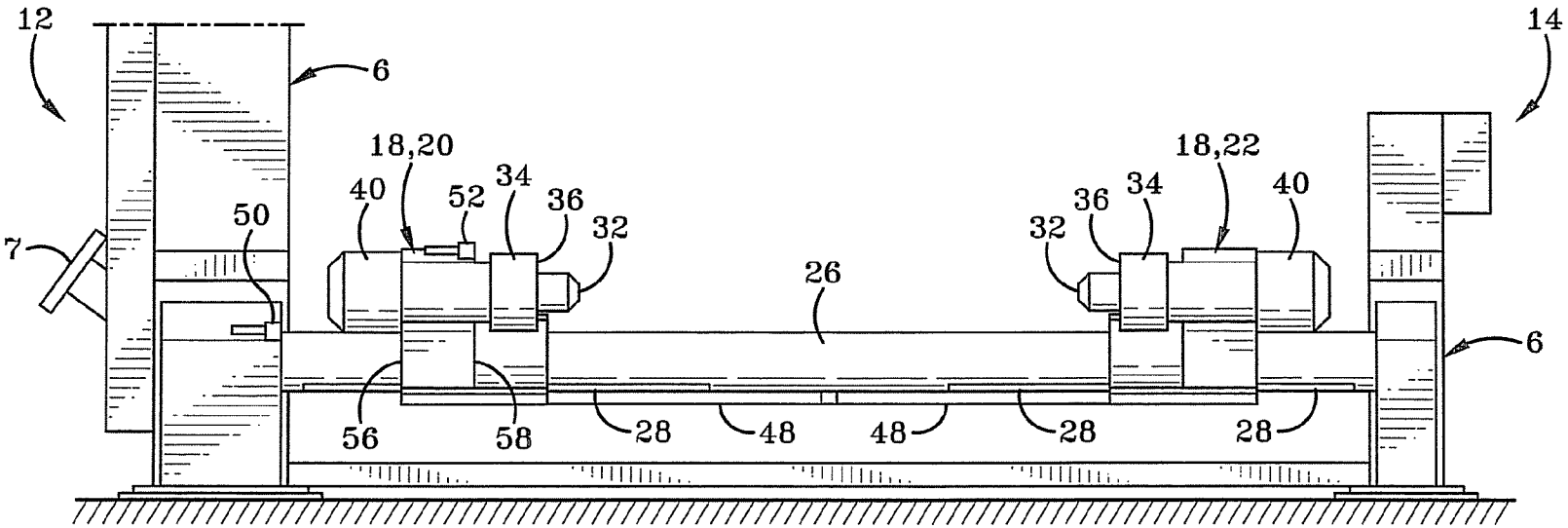
FIG. 2 is an end elevational view of the lower portion of the machine.
Figure 3:
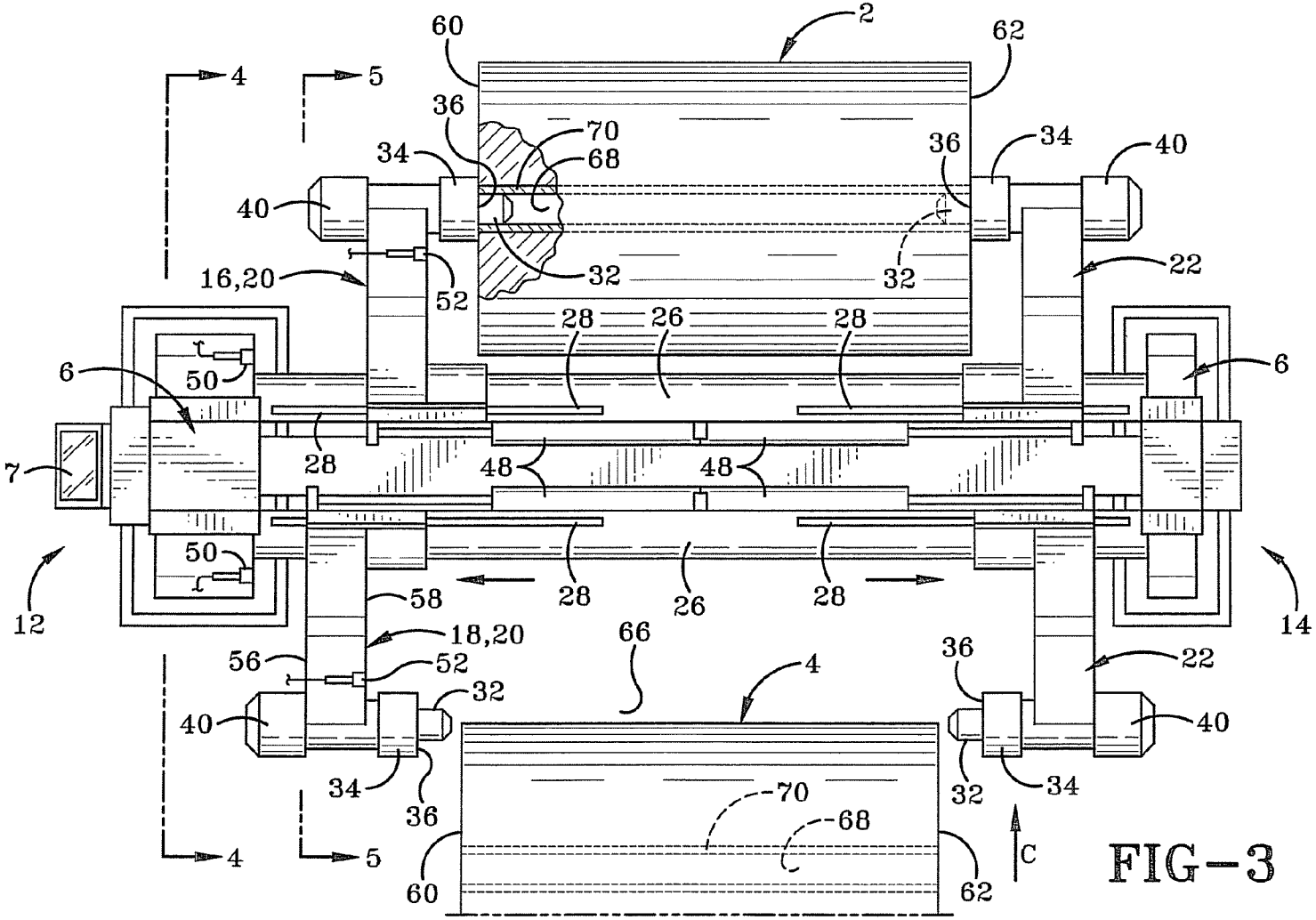
FIG. 3 is a top plan view of the machine showing one roll of paperboard mounted on the machine and a second roll of paperboard being positioned for mounting on the machine.

Machine 1 includes a rigid stationary frame 6 which typically includes several rigid uprights which support longitudinal rails with rigid horizontal beams extending therebetween to form a rigid structure on which the various moving parts of the machine are mounted. Machine 1 has upstream and downstream ends 8 and 10 defining therebetween a longitudinal direction and more particularly a downstream direction (arrow A in FIG. 1) in which the webs of paperboard ultimately travel after unwound from rolls 2 and 4. Machine 1 has left and right sides 12 and 14 (FIGS. 2, 3) defining therebetween an axial direction. Machine 1 includes first and second roll loading or support assemblies 16 and 18 each including left and right roll support arm assemblies which respectively include left and right roll loading or support arms 20 and 22 which are axially spaced from one another. Each arm 20 and 22 adjacent one end is pivotally mounted on frame 6 at a respective pivot 24 whereby the arms of each assembly 16 and 18 are respectively pivotally mounted about horizontal parallel axially extending axes passing through pivots 24. More particularly, a pair of parallel axially elongated support shafts 26 are pivotally mounted on frame 6 about the axes of pivots 24 with the corresponding set of arms 20 and 22 mounted on and extending radially outwardly from the corresponding shaft 26 in order to rotate therewith. Axially elongated keyways 28 are formed in each support shaft 26 for receiving therein respective keys 30 of arms 20 and 22 whereby arms 20 and 22 are movable in the axial direction relative to shaft 26 with keys 30 sliding within the respective keyways 28. Mounted adjacent the terminal outer end of each arm 20 and 22 are respective chucks 32 extending outwardly from a respective annular collar 34 having an annular generally vertical stop or stop surface 36. Each chuck 32 is rotably mounted about a pivot or pivot axis 38 which is horizontal and axially extending whereby axes 38 are parallel to axes 24. The rotatable nature of chucks 32 thus allows for a given roll 2 or 4 when mounted thereon to rotate about the corresponding axis 38 to allow the web to unwind from the roll of paperboard. A brake 40 is also mounted adjacent the outer end of each arm 20 and 22 to provide braking ability to slow or stop the rotation of chucks 32 of the corresponding roll mounted thereon.

Figure 4:
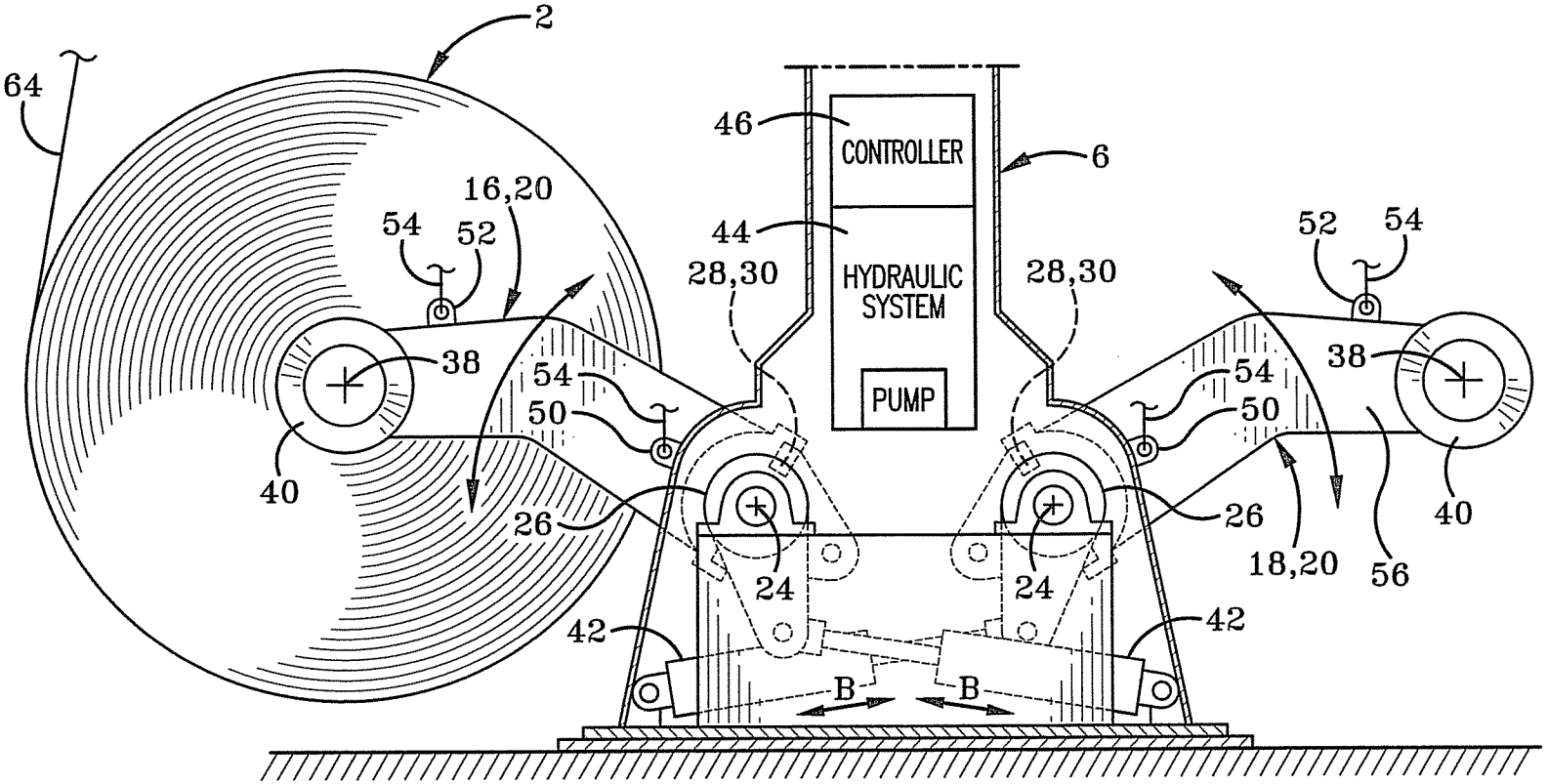
FIG. 4 is a sectional view taken on line 4-4 of FIG. 3.
Figure 5:
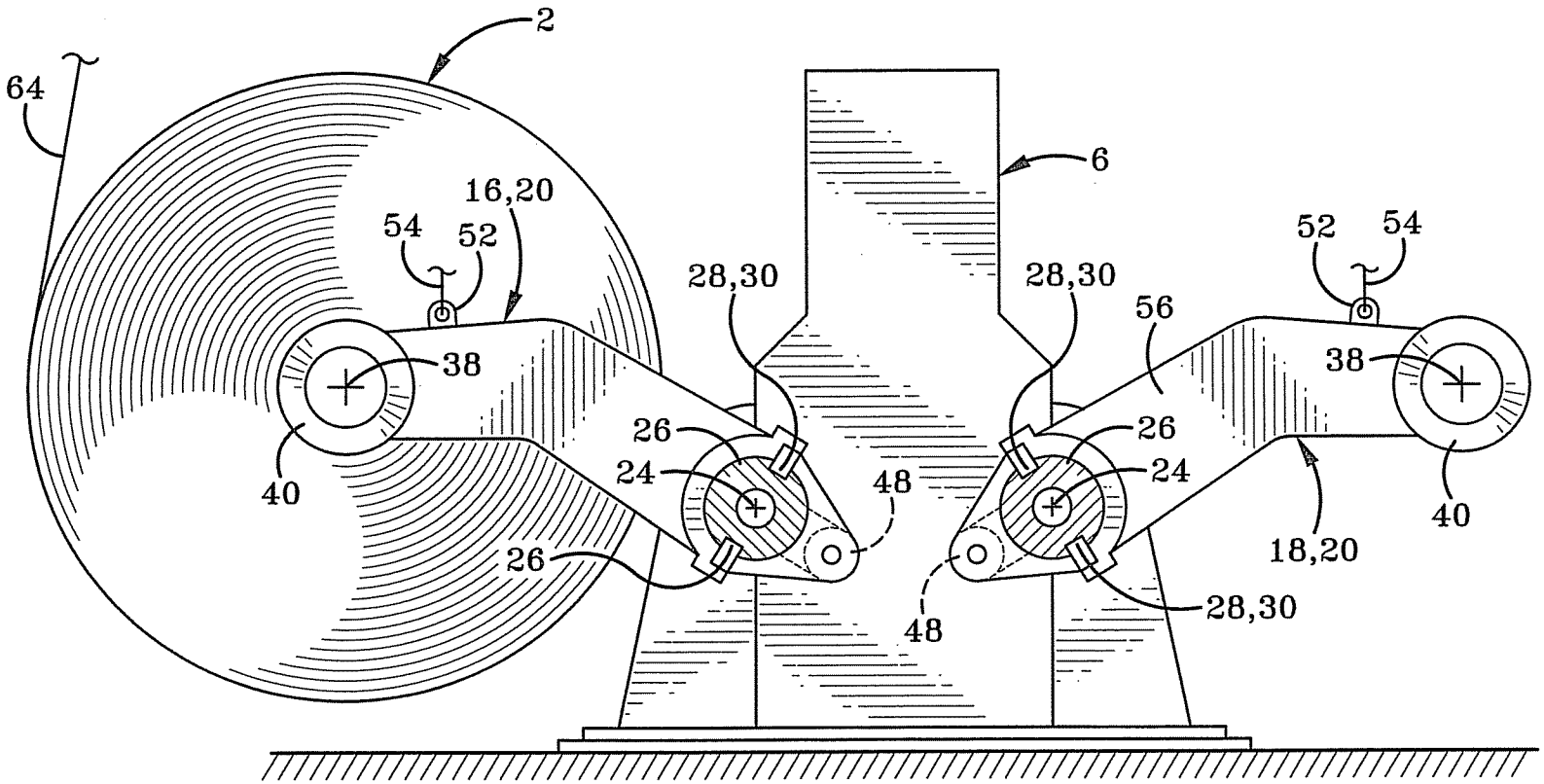
FIG. 5 is a sectional view taken on line 5-5 of FIG. 3.

Actuators 42 (FIG. 4) are provided for driving the pivotal movement of arms 20 and 22 respectively about axes 24 in order to raise and lower the outer ends of set arms and rolls 2 or 4 therewith. In the exemplary embodiment, each actuator 42 is in the form of a piston-cylinder combination wherein the cylinder is pivotally mounted on frame 6 and the cylinder is pivotally mounted on a respective one of arms 20 and 22 whereby extension and retraction of the piston (arrows B) drives the pivotal movement of the respective arm. In the exemplary embodiment, a hydraulic system 44 including a hydraulic pump is provided to power actuators 42. A control unit or controller 46 is provided to allow the operator of machine 1 to control the various operations thereof and thus typically includes various control buttons, knobs, switches and the like. Controller 46 includes a suitable computer or logic circuits for making calculations described further below. A display monitor or screen 7 is in electrical communication with controller 46. In addition to lift actuators 42, clamping actuators 48 (FIG. 3) are mounted on frame 6 to drive the axial movement of the left and right arms 20 and 22 relative to support shaft 26. In the exemplary embodiment, actuators 48 are in the form of piston-cylinder combinations and are hydraulically operated. Thus, the hydraulic system 44 is in fluid communication with actuators 42 and 48 to provide hydraulic fluid thereto.

In accordance with the invention, machine 1 includes an alignment mechanism or assembly which includes first and second distance sensors 50 and 52 which are in electrical communication with controller 46 via respective electrical wires 54. Sensors 50 and 52 are parts of measurement devices for measuring axial distance as discussed further below. Sensors 50 and 52 in the exemplary embodiment are ultrasonic sensors each of which produces an ultrasonic wave (dashed lines in FIGS. 6 and 7) which reflect respectively off the left side 56 of arm 20 and left end 60 of roll 4, thereby allowing the ultrasonic waves to determine the distance from the sensor to the respective reference point. Other suitable sensors may be used. Each sensor 50 is securely mounted on frame 6 or adjacent frame 6 so that sensor 50 is fixed relative to the frame and is configured for measuring the horizontal axial distance from a reference point such as the right side of sensor 50 to another reference point such as the left side 56 of the corresponding left arm 20. Sensor 52 is configured to measure the horizontal axial distance from a reference point such as the right side of sensor 52 or right side 58 of left arm 20 to a reference point such as the left end 60 of the corresponding roll 2 or 4. Each roll further has a right end 62 whereby left and right ends 60 and 62 also serve as the left and right edges of the web 64 of paperboard which unwinds from the respective roll. The reference point represented by the right side of sensor 50, which is axially fixed with respect to frame 6, is to the left of the left arm assembly 20, the left end 60 of roll 4 and the various other reference points mentioned herein. The reference point on left arm assembly 20 represented by left side 56 is to the left of the reference points 58 and 60, and is axially movable as left arm 20 moves axially although reference point 56 is axially fixed when the left arm assembly is secured against axial movement and thus fixed relative to frame 6 at a given time. Reference point 58 is similarly axially movable and may be fixed in the same manner as reference point 56, and is to the left of reference point 60.

Figure 6:
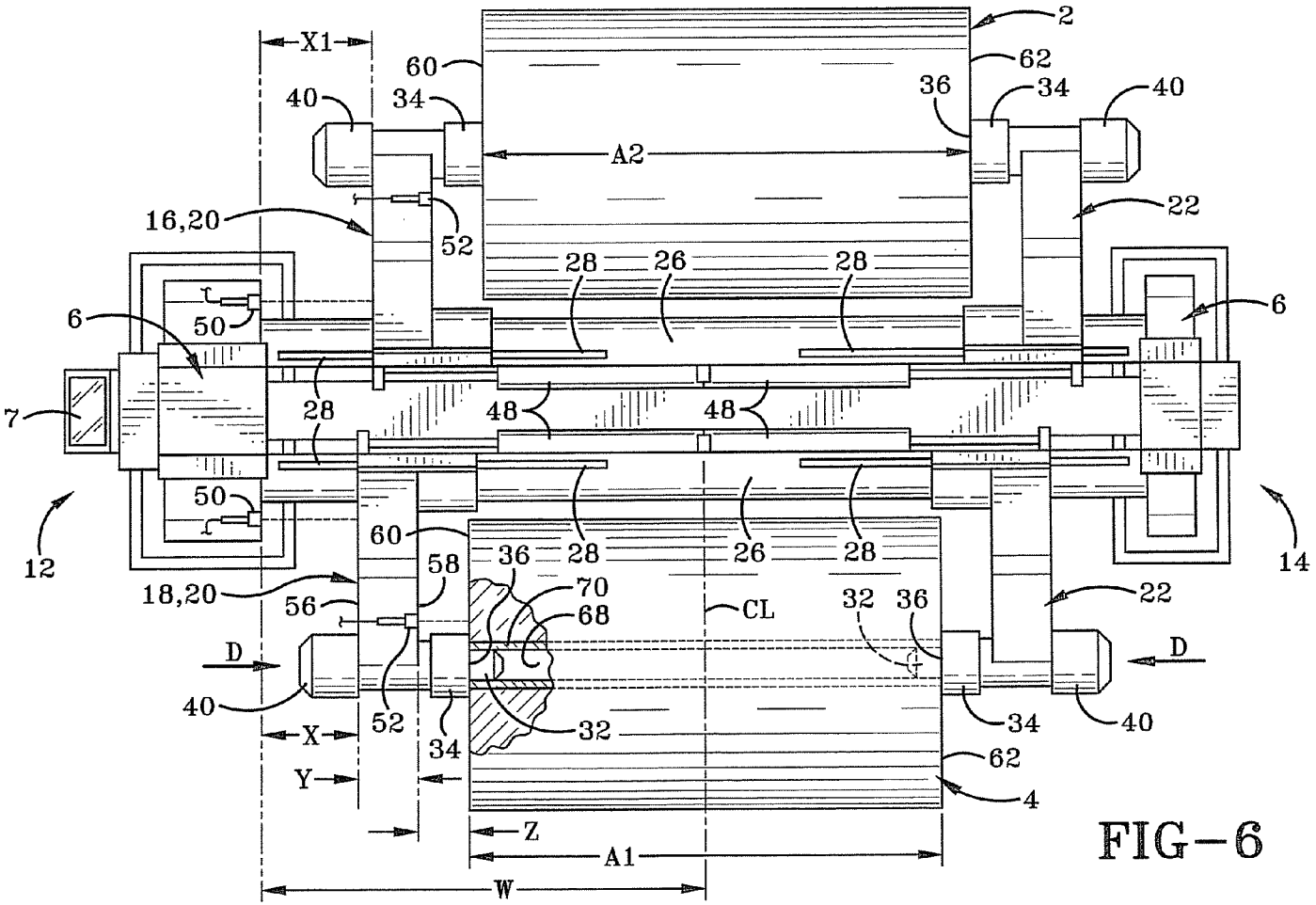
FIG. 6 is a top plan view of the machine showing the second roll of paperboard mounted on the machine out of alignment with the first roll.

The operation of machine 1 is now described. As shown throughout the Figures, the first roll 2 has already been mounted on first assembly 16 and aligned in the axial direction to the desired position in the same manner as will be described below with respect to second roll 4. The lift actuator 42 associated with second assembly 18 is extended or retracted in order to pivot the arm along with its corresponding chuck 32, collar 34 and brake 40 about pivot axis 24 to raise or lower the chucks 32 to the correct height needed for mounting roll 4 thereon. Roll 4 is then inserted (arrow C in FIG. 3) into a roll receiving space 66 defined between the left and right arm assemblies of assembly 18. This insertion of roll 4 into space 66 is done so that a central passage 68 defined by a cylindrical core 70 of roll 4 is aligned (FIG. 6) with chucks 32 on either end thereof. Web 64 of paperboard is wound around core 70 to form roll 4. Once the chucks 32 are aligned with passage 68, actuators 48 are operated to insert chucks 32 axially into the left and right ends of passage 68 (arrows D in FIG. 6) to mount roll 4 on assembly 18. At this stage, left end 60 and right end 62 of roll 4 is typically closely adjacent or abutting the opposed stop surfaces 36 of the corresponding collars 34. Once roll 4 is mounted in this fashion, the axial distance between arms 20 and 22 is fixed throughout the following steps of the process until it is time to remove core 70 (and roll 4 if necessary) from assembly 18. As illustrated in FIG. 6, the left edge 60 of roll 4 is axially offset from the left edge 60 of roll 2 such that the left edges 60 are not axially aligned with one another. Thus, actuators 48 are operated to move the left and right arm assemblies of assembly 18 axially in a coordinated fashion at the same rate to the right (arrow E of FIG. 7) so that left edges 60 are aligned with one another as clarified by the dot-dashed line F. Although the left edges 60 are axially aligned with one another, FIG. 7 also illustrates that the right edges 62 of rolls 2 and 4 are not aligned with one another inasmuch as the axial width of the rolls 2 and 4 in the exemplary embodiment are different. More particularly, roll 4 has an axial width A1 defined between its left and right end 60 and 62 which is less than the axial width A2 of roll 2 defined between its left and right end 60 and 62. The difference between axial width A1 and axial width A2 is typically no more than about one ½ inch although this may vary, and these widths may be equal.

The alignment mechanism of the present invention is configured to ensure that the left edges 60 are aligned with one another. The use of the alignment mechanism is discussed primarily with reference to FIG. 6. Sensor 50 is positioned so that its right edge is an axial distance W from a reference point which is axially between the left and right arm assemblies and the left and right ends 60 and 62 of roll 4. This reference point is preferably a center line CL of machine 1 which is generally midway between left and right sides 12 and 14. Reference point CL is axially fixed relative to frame 6, is to the right of all the other reference points mentioned herein, is to the right of the left arm assembly and left end 60, and is to the left of the right arm assembly and right end 62. Width W is a fixed distance which is measured with a suitable measuring device. Sensor 50 is configured to measure an axial distance X defined between the right side of sensor 50 and left side 56 of left arm 20. Axial distance X varies depending on the axial position of arm 20. Left and right sides 56 and 58 define therebetween an axial width Y of arm 20, which is a fixed distance measured by a suitable measuring device. Sensor 52 is configured to measure an axial distance Z defined between the right side of sensor 52 or right side 58 of arm 20 and the left end 60 of roll 4. Distance Z will vary depending on the axial position of roll 4 relative to arm 20 and sensor 52. In many cases, distance Z will be substantially the same as the distance between the right side of sensor 52 or right side 58 and the right stop surface 36 of collar 34 mounted on left arm 20 inasmuch as left end 60 of roll 4 may abut said surface 36. However, left end 60 may be axially spaced from surface 36 such that distance Z is different than the axial distance between right side 58 or the right side of sensor 52 and surface 36. In any case, controller 46 uses as inputs the axial distances W, X, Y and Z as respective measured values in order to calculate the axial position of left edge 60 so that it may be properly aligned depending on the width of a given roll. In the paperboard industry, one of the standard axial roll widths is 110 inches and another standard width is 98 inches. More particularly, each of these standard widths represents an ordered width which has been ordered by the operator or customer using machine 1. However, as previously noted, the actual width is often slightly greater than the ordered width by a ⅛ inch, ¼ inch or so forth.

Figure 7:
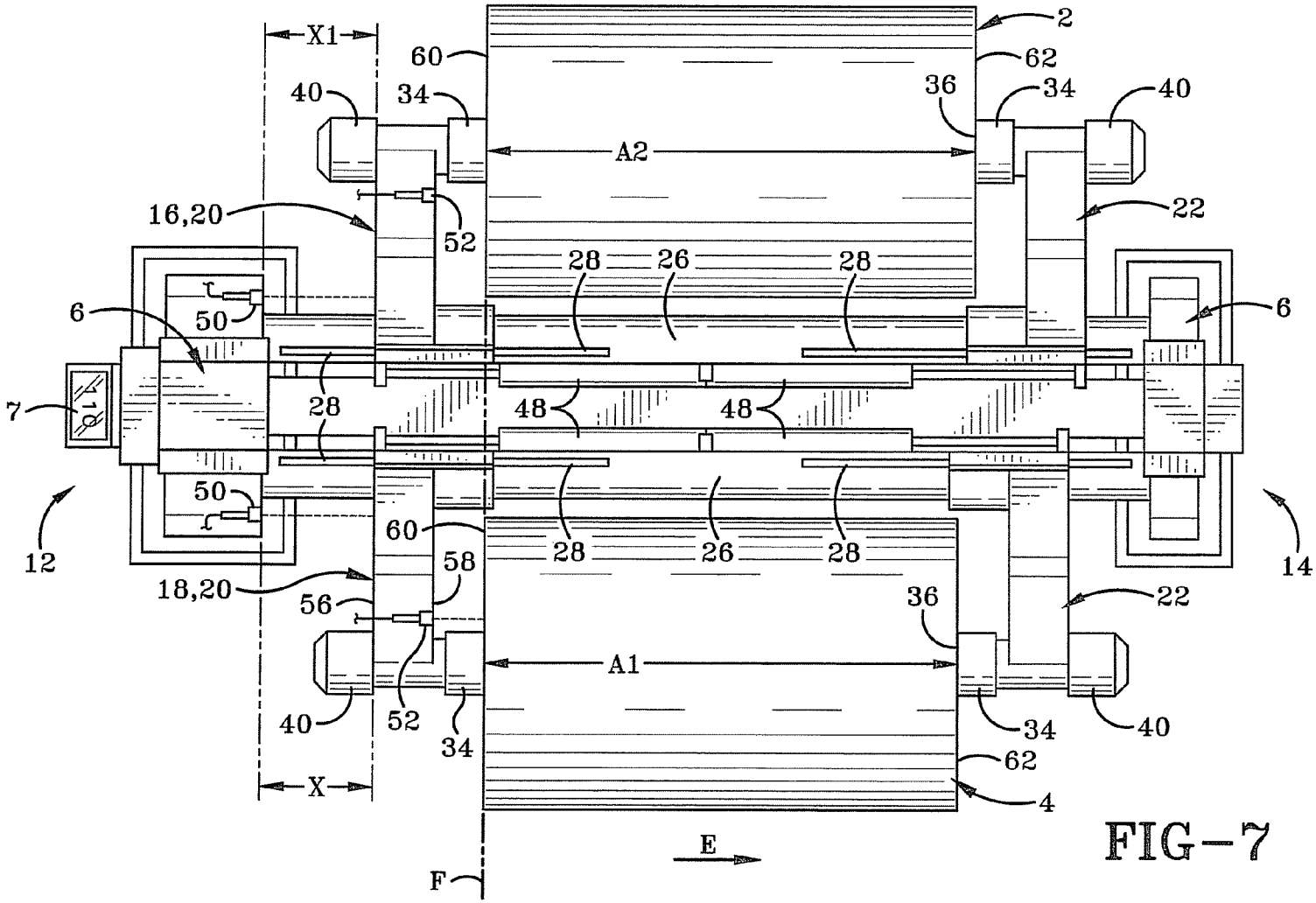
FIG. 7 is a top plan view of the machine showing the machine having moved the second roll into alignment with the first roll.

In the exemplary embodiment, in order to determine the axial position of roll 4, controller 46 calculates the ordered axial width of roll 4 based on axial distances W, X, Y and Z. More particularly, the ordered axial width of roll 4, which is equal to or slightly less than the actual axial width A1, is two times the difference between axial distance W and the sum of axial distances X, Y and Z. Thus, controller 46 includes a computer program which utilizes this mathematical formula to calculate the ordered axial width of roll 4 and display the value of this axial width on screen 7, as shown in FIG. 7. Although FIG. 7 shows the calculated value of 110 inches corresponding to the ordered axial width of roll 4 when it is aligned properly relative to frame 6 so that the left ends 60 of rolls 2 and 4 are axially aligned, the calculated value will obviously be different when the axial position of roll 4 is not at the aligned position. Thus, the value which would be displayed on screen 7 when roll 4 is in the position shown in FIG. 6 would be different than the ordered axial width of roll 4. In the exemplary embodiment, the operator of machine 1 thus loads roll 4 on support assembly 18 as previously described and then watches or views screen 7 to see if the value displayed thereon as calculated by controller 46 matches the ordered axial width which the operator knows in advance. Thus, in the example shown, the roll 4 is moved axially to the right from the position of FIG. 6 to the position of FIG. 7 while mounted on support assembly 18 while controller 46 performs real time calculations based on the various inputs and displays the value in real time on screen 7 associated with any given axial position of roll 4. When the value displayed on screen 7 equals the known or predetermined ordered axial width of roll 4, the operator stops the axial movement of support assembly 18 and roll 4 at the correct axial position at which the roll is properly aligned and secures support assembly 18 against axial movement in order to ensure that the rolls 2 and 4 remain properly aligned during the subsequent operation of machine 1.

Alternately, controller 46 may be configured to make the comparison between the measured axial width of roll 4, and thus its axial position, and the ordered axial width and thus the correct aligned position. More particularly, the ordered axial width value may be input into controller 46 whereby the logic circuits of controller 46 compare this value with the measured axial width of roll 4 so that when they match, controller 46 controls actuators 48 to automatically stop the axial movement of assembly 18 and roll 4 at the correct or aligned axial position.

As previously noted, reference point CL is preferably a center line of the machine, which makes the mathematical formula noted above apply equally to any given ordered axial width. Thus, the alignment mechanism may be used as well with the 98 inch roll or any other axial width of the roll to properly calculate the axial position of the roll.

In the foregoing description, certain terms have been used for brevity, clearness, and understanding. No unnecessary limitations are to be implied therefrom beyond the requirement of the prior art because such terms are used for descriptive purposes and are intended to be broadly construed.

Moreover, the description and illustration of the invention is an example and the invention is not limited to the exact details shown or described.

The invention claimed is:

1. A method comprising the steps of:

providing a paperboard handling machine comprising a frame and a roll support assembly having left and right roll support arm assemblies which are movably mounted on the frame;

mounting a first paperboard roll having left and right ends on the roll support assembly between the left and right arm assemblies;

while the first paperboard roll is mounted on the left and right arm assemblies, measuring with a first distance sensor a first axial distance from a first reference point which is axially fixed relative to the frame to a second reference point on the left arm assembly;

while the first paperboard roll is mounted left and right arm assemblies, measuring with a second distance sensor a second axial distance from a third reference point on the left arm assembly to the left end of the roll;

calculating with a logic circuit a first axial position of the roll based on the first axial distance; wherein the step of calculating the first axial position is based on the second axial distance;

comparing the calculated first axial position with a predetermined correct axial position; and if the first and correct axial positions are different from one another, adjusting the roll axially while mounted on the roll support assembly to move the roll from the first axial position to the correct axial position.

2. The method of claim 1 wherein the second and third reference points define therebetween a third axial distance; and the step of calculating the first axial position is based on the third axial distance.

3. The method of claim 2 wherein a fourth reference point to the right of the left end of the roll and the first reference point define therebetween a fourth axial distance; and the step of calculating the first axial position is based on the fourth axial distance.

4. The method of claim 3 wherein the step of calculating the first axial position comprises the step of subtracting a sum of the first, second and third axial distances from the fourth axial distance to obtain a difference.

5. The method of claim 4 wherein the step of calculating comprises the step of multiplying the difference by a factor.

6. A method comprising the steps of:

providing a paperboard handling machine comprising a frame and a roll support assembly having left and right roll support arm assemblies which are movably mounted on the frame;

mounting a first paperboard roll having left and right ends on the roll support assembly between the left and right arm assemblies;

ascertaining a first value representing an ordered axial width of the roll;

while the first paperboard roll is mounted on the left and right arm assemblies, measuring a first axial distance from a first reference point to a second reference point, wherein the first reference point is to the left of the left end of the roll and the second reference point is to the right of the left end of the roll and to the left of the right end of the roll;

determining a second axial distance from the first reference point to the left end of the roll;

calculating a calculated value including subtracting the second axial distance from the first axial distance; and moving the roll axially while mounted on the roll support assembly to a position at which the calculated value equals the first value.

7. The method of claim 6 wherein the second reference point is a center line of the paperboard handling machine.

8. A paperboard handling machine configured for handling a paperboard roll having left and right ends, the machine comprising:

a frame;

left and right axially spaced roll support arm assemblies mounted on and axially adjustable relative to the frame;

a roll-receiving space which is defined between the left and right arm assemblies and comprises a left side adjacent the left arm assembly and a right side adjacent the right arm assembly; the space adapted to receive therein the paperboard roll with the left and right ends respectively adjacent the left and right sides of the space;

a first distance sensor which is axially fixed relative to the frame and configured to measure a first axial distance from a first reference point to a reference point on the left arm assembly; and a second distance sensor which is fixedly mounted on the left arm assembly and configured to measure a second axial distance from a second reference point to the left side of the roll-receiving space.

* * * * *